US007510347B2

(12) United States Patent
Lemke

(10) Patent No.: US 7,510,347 B2
(45) Date of Patent: Mar. 31, 2009

(54) MACHINE FOR MILLING TRAFFIC AREAS

(75) Inventor: Bernd Lemke, Moringen (DE)

(73) Assignee: ABG Allgemeine Baumaschinen-Gesellschaft mbH, Hameln (DE)

( * ) Notice: Subject to any disclaimer, the term of this patent is extended or adjusted under 35 U.S.C. 154(b) by 156 days.

(21) Appl. No.: 11/204,850

(22) Filed: Aug. 16, 2005

(65) Prior Publication Data

US 2006/0039757 A1 Feb. 23, 2006

(30) Foreign Application Priority Data

Aug. 19, 2004 (DE) ..... 10 2004 040 136

(51) Int. Cl.
*E01C 23/088* (2006.01)

(52) U.S. Cl. ..... 404/84.5; 404/84.05; 404/84.1; 299/1.5; 299/1.05

(58) Field of Classification Search ..... 404/84.05, 404/84.5, 93, 94; 299/1.5, 36.1, 39.6; 356/4.08, 356/4.01, 5.01, 5.1; 37/348; 172/4, 4.5, 172/5; 701/50, 223, 301
See application file for complete search history.

(56) References Cited

U.S. PATENT DOCUMENTS 3,706,284 A * 12/1972 Plasser et al. ..... 104/7.2
3,727,332 A * 4/1973 Zimmer ..... 37/97
4,655,633 A * 4/1987 Somero et al. ..... 404/75
5,039,249 A * 8/1991 Hansen et al. ..... 404/84.5
5,129,803 A * 7/1992 Nomura et al. ..... 425/62
5,533,790 A * 7/1996 Weiland ..... 299/1.5
5,556,226 A * 9/1996 Hohmann, Jr. ..... 404/84.1
5,607,205 A * 3/1997 Burdick et al. ..... 299/1.5
5,787,369 A * 7/1998 Knaak ..... 701/19
6,152,648 A * 11/2000 Gfroerer et al. ..... 404/84.05
6,203,112 B1 * 3/2001 Cook et al. ..... 299/39.3
6,371,566 B1 * 4/2002 Haehn ..... 299/1.5
6,405,132 B1 * 6/2002 Breed et al. ..... 701/301
6,916,070 B2 7/2005 Sehr
2004/0068896 A1 * 4/2004 Sehr ..... 37/413

FOREIGN PATENT DOCUMENTS

DE 196 32 456 C1 8/1996
DE 100 60 903 C2 10/2002

* cited by examiner

*Primary Examiner*—Raymond W Addie
(74) *Attorney, Agent, or Firm*—Alix, Yale & Ristas, LLP

(57) ABSTRACT

The invention relates to a machine for milling traffic areas. The machine has a vertically adjustable chassis which carries a steerable traveling mechanism and a drive unit for moving the machine and for driving a milling mechanism coupled to the drive unit. A laser scanner is attached to at least on one side of the chassis. With the laser scanner, the height relative to the surface of a traffic area to be milled can be measured and the chassis can be set vertically in accordance with the measured values relative to the surface of the traffic area to be milled. The laser scanner is attached in the center side-wall region of the chassis. The scanning plane of the laser scanner is essentially parallel to the side-wall region of the chassis and at a height which permits monitoring of a hazard region which extends at least over the side length of the machine. The laser scanner produces a trigger signal if a disturbance occurs in the scanning plane.

9 Claims, 1 Drawing Sheet

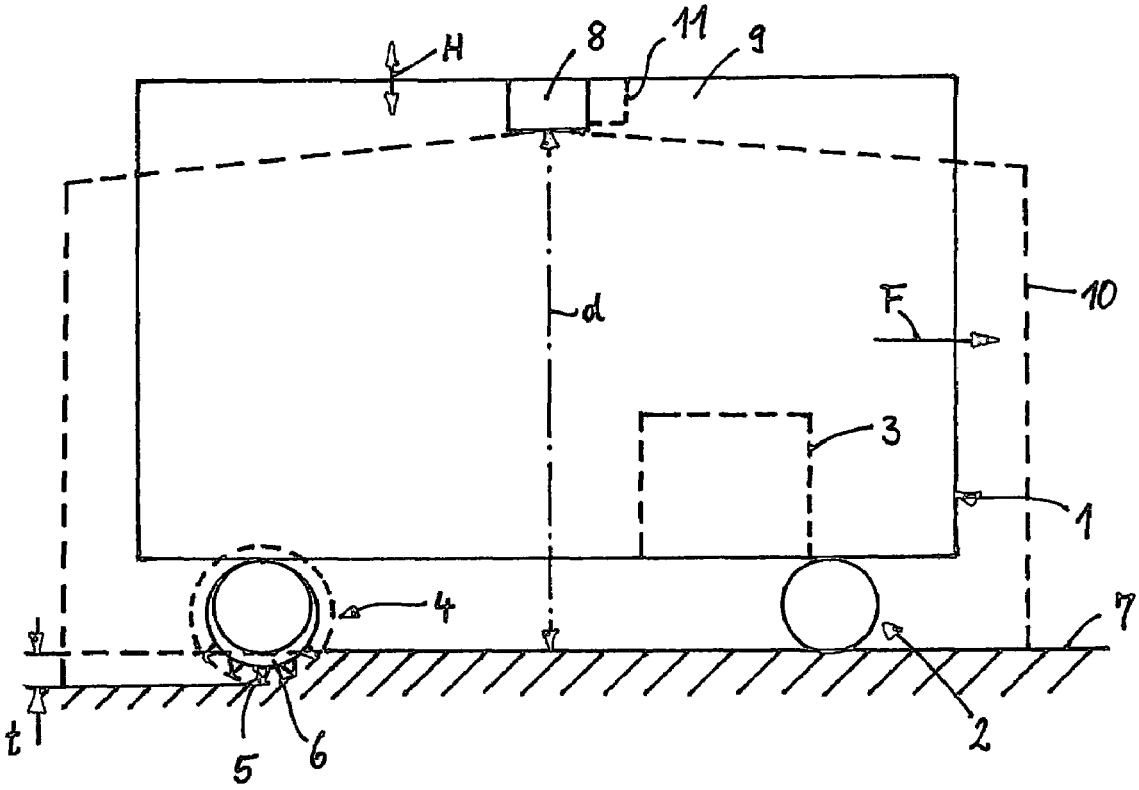
H
8
11
9
d
F
10
3
1
4
7
t
5
6
2

MACHINE FOR MILLING TRAFFIC AREAS

FIELD OF THE INVENTION

The invention relates to a machine for milling traffic areas as roads or the like for instance to remove a defective layer to be replaced by subsequent paving.

BACKGROUND OF THE INVENTION

WO 93/08003 discloses a machine for milling floor areas inside a building for the purpose of leveling, in which machine a device for detecting the height of the floor is provided, this detecting device comprising a laser receiver on the machine, and this laser receiver evaluates an external laser beam which represents the reference height and replaces a reference cord which is otherwise used. According to said document, the height of the rear wheels is adjusted and thus the milling depth is kept at an intended level.

Furthermore, German Patent No. DE 196 32 456 C1 discloses a self-propelled, i.e. driverless, machine for skimming artificial grounds, such as sand tennis courts or the like, in which, for determining the position in connection with markings located on the grounds and thus for the steering, a laser scanner is used which accordingly scans the region in the travel direction in front of the machine with respect to the markings in a horizontal plane and stops the machine if objects which are not envisaged, such as persons, or larger objects are detected in its path.

It is also known in machines for milling traffic areas, so-called "road milling cutters", to use height regulation in order to set and maintain a certain milling depth for the milling mechanism by adjusting the height of the chassis with respect to a traffic area to be milled.

In addition, in the case of machines for milling traffic areas, there is the problem that persons can move into the hazard region at the side of the machine, in particular at road edges, without being noticed by the driver of the machine.

SUMMARY OF THE INVENTION

An object of the invention is to provide a machine for milling traffic areas in which monitoring of the hazard region of the machine and height regulation can be carried out in a simple manner.

Accordingly, a machine for milling traffic areas comprising a vertically adjustable chassis is provided, which chassis carries a steerable travelling mechanism and a drive unit for moving the machine and for driving a milling mechanism coupled to the drive unit, a laser scanner being attached at least on one side of the chassis, with which laser scanner the height relative to the surface of a traffic area to be milled can be measured and the chassis can be set vertically in accordance with the measured values relative to the surface of the traffic area to be milled, the laser scanner being attached in the centre side-wall region of the chassis with its scanning plane essentially parallel to the side-wall region of the chassis and at a height which permits monitoring of a hazard region which extends at least over the side length of the machine and producing a trigger signal if a disturbance occurs in the scanning plane. In this way, the laser scanner performs a double function which, in addition to the height regulation, results in monitoring of the hazard region without substantial cost.

Further objects, advantages and embodiments of the invention can be gathered from the description below.

BRIEF DESCRIPTION OF THE DRAWING

The invention is explained in more detail below with reference to an exemplary embodiment, shown schematically in side view in the attached figure, of a machine for milling traffic areas.

DETAILED DESCRIPTION OF THE PREFERRED EMBODIMENT

The machine shown for milling traffic areas comprises a chassis 1 which is arranged in a vertically adjustable manner relative to a travelling mechanism 2 which can be driven via a drive unit 3, for instance a diesel engine, installed in the chassis 1. A milling mechanism 4, which can likewise be driven via the drive unit 3 and comprises a milling drum 6 fitted with milling bits 5, is attached below and to the chassis 1.

The height of the chassis 1 relative to a traffic area 7 to be milled is measured via a laser scanner 8. The laser scanner 8 is located in the top centre side-wall region of the chassis 1 on a side wall 9 thereof and is attached with its scanning plane essentially parallel to the side wall 9. Laser scanners normally have an angular scanning range of about 180°, so that a defined hazard region 10 which is located in front of the side wall 9 of the chassis 1 is scanned by the laser scanner 8. The laser scanner 8 therefore firstly scans the distance d from the traffic area 7, the chassis 1 being regulated according to the measured values in accordance with the arrow H vertically relative to the surface of the traffic area 7, to be milled, for setting the milling depth t, and secondly it scans the region in front of the side wall 9 with regard to the penetration of an object, for instance a person, into the defined hazard region 10 of the laser scanning curtain.

However, the laser scanner 8 detects a relatively large region, extending beyond the hazard region 10, of the surface profile of the traffic area 7, from which an average value is calculated as height reference, so that smaller local defects or pronounced roughness are/is compensated for in the reference value.

In the event of an object penetrating into the hazard region 10, i.e. if a disturbance in detection caused by this occurs, the laser scanner 8 transmits a trigger signal to a device 11 coupled to the laser scanner 8 for emitting an acoustic and/or optical warning signal, this trigger signal of the laser scanner 8 preferably also being used to stop the machine.

The laser scanner 8 is arranged, for example, on the right-hand side of the machine in the travel direction F, since the milling mechanism 4 is normally aligned with the side wall 9 of the machine on the right. However, a laser scanner 8 may also preferably be arranged on each side of the machine.

The laser scanner 8 may also be arranged in a deeper position as long as the hazard region 10 can be selected to be sufficiently large, i.e. so as to extend at the front and if need be at the rear slightly beyond the length of the machine, so that, at the maximum working or travel speed of the machine, escape from the hazard region is made possible in view of a trigger warning signal. In the case of large machines, the arrangement of the laser scanner 8 approximately halfway up the machine enables said laser scanner to be arranged below the ladder-like step to the control platform, so that the laser scanner 8 is protected by the step.

Smaller machines for milling traffic areas 7 often have a swing-out rear wheel, so that, when the rear wheel is swung out, both rear wheels are arranged coaxially and the milling drum 6 is located with its axis in a vertical plane through the rear wheel axis, as shown in the attached figure. In this case, the hazard region 10 can be defined accordingly or the laser scanner 8 can be arranged so as to project by an appropriate distance, so that no warning signal is produced by the swung-out rear wheel.

While the invention has been shown and described with reference to preferred embodiments, it should be apparent to one of ordinary skill in the art that many changes and modifications may be made without departing from the spirit and scope of the invention as defined in the claims.

What is claimed is:

1. A machine for milling traffic areas, the machine comprising:

a vertically adjustable chassis carrying a steerable traveling mechanism and a drive unit for moving the machine and for driving a milling mechanism coupled to the drive unit;

at least one laser scanner disposed on a vertically extending side of the chassis for measuring the height relative to the surface of a traffic area to be milled;

wherein the chassis is adjustable vertically in accordance with the measured values relative to the surface of the traffic area to be milled; and wherein the laser scanner is attached in a center side-wall region of the chassis, the laser scanner having a scanning plane disposed substantially parallel to the side-wall region of the chassis and at a height adapted for substantially continuous monitoring of a hazard region of a laser scanning curtain extending at least over a side length of the machine and producing a trigger signal if a disturbance occurs in the hazard region.

2. The machine according to claim 1, wherein the trigger signal is useable by a device for emitting at least one of an acoustic and optical warning signal.

3. The machine according to claim 1, wherein the trigger signal is adapted for immediately stopping the machine.

4. The machine according to claim 1, wherein the laser scanner is attached in the top center side-wall region of the chassis.

5. The machine according to claim 1, wherein the laser scanner is arranged approximately halfway up the center side-wall region of the chassis.

6. The machine according to claim 1, wherein the laser scanner is attached at a height whereby the hazard region extends beyond the side length of the machine with respect to the front side of the machine.

7. The machine according to claim 6, wherein the hazard region extends beyond the side length of the machine with respect to the rear side of the machine.

8. A machine for milling traffic areas, the machine comprising:

a vertically adjustable chassis carrying a steerable traveling mechanism and a drive unit for moving the machine and for driving a milling mechanism coupled to the drive unit;

at least one laser scanner disposed on a vertically extending side of the chassis for measuring the height relative to the surface of a traffic area to be milled;

wherein the chassis is adjustable vertically in accordance with the measured values relative to the surface of the traffic area to be milled; and wherein the laser scanner is attached in a center region of the side of the chassis, the laser scanner having a scanning plane disposed substantially parallel to the side of the chassis and at a height adapted for substantially continuously monitoring of a hazard region extending at least over a side length of the machine, the scanning plane including a proximal portion and a distal portion extending from the proximal portion, the proximal portion defining a hazard region of a laser scanning curtain, the laser scanner producing a trigger signal if a disturbance occurs in the hazard region, the laser scanner computing an average height of the traffic area surface in a combination of the scanning plane proximal and distal portions as a height reference.

9. A machine for milling traffic areas, the machine comprising:

a vertically adjustable chassis carrying a steerable traveling mechanism and a drive unit for moving the machine and for driving a milling mechanism coupled to the drive unit;

at least one laser scanner disposed on a vertically extending side of the chassis for measuring the height relative to the surface of a traffic area to be milled;

wherein the chassis is adjustable vertically in accordance with the measured values relative to the surface of the traffic area to be milled; and wherein the laser scanner is attached in a center region of the side of the chassis, the laser scanner having a scanning plane disposed substantially parallel to the side of the chassis, the laser scanner substantially continuously scanning across the scanning plane to scan the scanning plane as a defined hazard region of a laser scanning curtain and producing a trigger signal if a disturbance occurs in the hazard region.

* * * * *